US006621216B2

(12) United States Patent
Chen et al.

(10) Patent No.: US 6,621,216 B2
(45) Date of Patent: Sep. 16, 2003

(54) PLASMA DISPLAY PANEL WITH DRIVING CIRCUIT ONE SIDEDLY AND ITS MANUFACTURING METHOD

(75) Inventors: Po-Cheng Chen, Hsinchu (TW); Jiun-Han Wu, Hsinchu (TW)

(73) Assignee: Acer Display Technology, Inc., Hsinchu (TW)

( * ) Notice: Subject to any disclaimer, the term of this patent is extended or adjusted under 35 U.S.C. 154(b) by 453 days.

(21) Appl. No.: 09/731,512

(22) Filed: Dec. 7, 2000

(65) Prior Publication Data

US 2001/0040432 A1 Nov. 15, 2001

(30) Foreign Application Priority Data

May 12, 2000 (TW) ..... 89109190 A

(51) Int. Cl.[7] ..... H01J 17/49

(52) U.S. Cl. ..... 313/582; 313/583; 313/584; 313/586

(58) Field of Search ..... 313/582–587, 313/493; 345/41, 55, 60

(56) References Cited

U.S. PATENT DOCUMENTS 5,977,708 A * 11/1999 Amatsu et al. ..... 313/586
6,346,772 B1 * 2/2002 Nishiki et al. ..... 313/587
6,528,944 B1 * 3/2003 Kishi et al. ..... 313/582

* cited by examiner

*Primary Examiner*—David V. Bruce
*Assistant Examiner*—Jurie Yun
(74) *Attorney, Agent, or Firm*—Mathews, Collins, Shepherd & McKay, P.A.

(57) ABSTRACT

A plasma display panel (PDP) with a driving circuit one-sidedly and its manufacturing method is disclosed. The PDP includes a first substrate having a first edge, a second substrate spaced apart from the first substrate, a first electrode positioned on the first substrate along a first direction, a second electrode positioned on the second substrate along a second direction, a bonding electrode, and a conductive device. The second direction of the second electrode is substantially perpendicular to the first direction of the first electrode. The first substrate has a first length and the second substrate has a second length shorter than the first length. The bonding electrode is disposed on the first edge of the first substrate uncovered by the second substrate.

13 Claims, 11 Drawing Sheets

PLASMA DISPLAY PANEL WITH DRIVING CIRCUIT ONE SIDEDLY AND ITS MANUFACTURING METHOD

FIELD OF THE INVENTION

The present invention relates to a plasma display panel (PDP) and its manufacturing method, and specifically to a plasma display panel with driving circuits one-sidedly and its manufacturing method.

BACKGROUND OF THE INVENTION

Cathode ray tubes (CRTs) have been widely used as TV displays and excel in resolution and picture quality. However, the depth and weight of CRTs sharp increase as the screen size increases. Therefore, in order to obtain a planar, full-colored, high-resolution TV with a large screen size (particularly exceeding 40 inches), the plasma display panel (PDPs) having a large screen size and a short depth is getting more and more attention. The PDP is lightened by plasma discharges and has millions of pixels. In detail, each pixel is formed as a discharge cell filled with inert gases. The inner wall of the cell is coated by a fluorescent material consisting of red (R), green (G), or blue (B) ultraviolet excited material. When a high voltage is exerted on the discharge cell, a plasma of the inert gases is introduced and an ultraviolet light is produced by the plasma in order to excite the fluorescent material to radiate red, green, or blue light.

FIG. 1 is a perspective view of a conventional PDP, and FIG. 2 is a sectional view of the conventional PDP shown in FIG. 1 along A–A' line. The PDP is mainly composed of a front substrate 12 and a rear substrate 11. The front substrate 12 includes a pair of scanning electrodes 13, a dielectric layer 14, and a protecting layer 16. The dielectric layer 14 is covered on the scanning electrode 13, and the protecting layer 16, preferably a MgO layer, is used for protecting the scanning electrode 13 and maintaining surface charges on the scanning electrode 13. The rear substrate 11 includes an addressing electrode 17 and a dielectric layer 18 for covering and protecting the addressing electrode 17. The directions of the scanning electrode 13 and that of the addressing electrode 17 are about perpendicular to each other. In addition, the PDP further includes a barrier rib 19 between the front 12 and rear substrates 11 for defining a plurality of the discharge cells 1. Each cell has a fluorescent material 10 coated on the inner wall and a mixed gas of xenon (Xe) and neon (Ne) sealed therein. When a high voltage is exerted at the electrodes 13 and 17, plasma discharges are activated in the discharge cells to excite the fluorescent material 10 to radiate visible lights. Further, the PDP further includes a sealing frit 15 between the front 12 and rear 11 substrates for sealing the two substrates.

The directions of the scanning electrode 13 and the addressing electrode 17 are about perpendicular to each other and the lengths of the two substrates are different from each other, so the edges of the two substrates are exposed after the two substrates 11•12 are sealed. Therefore, some parts of the bonding electrodes 131•171 on both substrates 11•12 are exposed as shown in FIG. 3. The exposed portions of the bonding electrodes 131•171 will be linked to two outer driving circuits (not shown) and driven by these driving circuits respectively. Since the sealing frit 15 does not have enough strength before glazing, the substrates must be compressed to seal until the sealing frit is completely glazed so as to prevent the position of the substrates from shifting and to maintain the distance between substrates. Therefore, the whole sealing process of the conventional PDP is very complicated, including two coating and glazing steps to maintain that the related position of the substrates. After the sealing process, two driving circuits for driving PDP are bonded on the substrates in direction A and direction B respectively, as shown in FIG. 3. Because the direction A is opposite to the direction B, it needs at lease two mounting steps to bond these driving circuits. This is very time-consuming and inconvenient.

It is therefore attempted by the applicant to deal with the above situation encountered with the prior art.

SUMMARY OF THE INVENTION

An object of the present invention is to provide a plasma display panel (PDP) and its manufacturing method. The PDP includes two glass substrates having electrodes thereon respectively, and the length of one substrate is longer than the other. The PDP further includes a bonding electrode and a conductive device for changing the power-supplying route of the electrode on the small substrate.

Another object of the present invention is to provide a PDP with driving circuits one-sidedly and its manufacturing method.

A further object of the present invention is to provide a PDP manufacturing method that is easy to sealing and positioning the two glass substrates.

The PDP of the present invention includes a first substrate having a first edge, a second substrate spaced apart from the first substrate, a first electrode positioned on the first substrate along a first direction, a second electrode positioned on the second substrate along a second direction, a bonding electrode, and a conductive device. The second direction of the second electrode is substantially perpendicular to the first direction of the first electrode. The first substrate has a first length and the second substrate has a second length shorter than the first length. The bonding electrode is disposed on the first edge of the first substrate uncovered by the second substrate. The conductive device has a first and a second conductive pads, the first conductive pad is protruded from the bonding electrode, and the second conductive pad is protruded from the second electrode and contacting with the first conductive pad. The bonding electrode on the first substrate is electrically connected with an outer circuit such that the second electrode of the second substrate is electrically connected with the outer circuit through the conductive device and the bonding electrode.

According to the present invention, the PDP further includes a sealing frit disposed between the first and the second substrates for sealing the two substrates. Besides, the PDP includes a barrier rib disposed between the first and the second substrates for defining a discharge cell or a plurality of discharge cells. The sealing frit can be positioned between the conductive device and the first edge of the first substrate or between the conductive device and the barrier rib.

A method for manufacturing the PDP described as above includes the steps of: (a) forming a first electrode on the first substrate along a first direction; (b) forming a bonding electrode on a first edge of the first substrate uncovered by the second substrate, and forming a first conductive pad on the bonding electrode; (c) forming a second electrode on the second substrate along a second direction, and forming a second conductive pad on a first end of the second electrode, the second direction being substantially perpendicular to the first direction; (d) connecting the first conductive pad with the second conductive pad, and bonding the first and the second substrates so that the second electrode of the second substrate is electrically connected to the bonding electrode of the first substrate; and (e) forming a sealing frit around the first substrate for sealing the first substrate and the second substrate. Alternatively, another method for manufacturing the PDP described as above includes the steps of: (a) forming a first electrode on the first substrate along a first direction; (b) forming a bonding electrode on a first edge of the first substrate uncovered by the second substrate, and forming a first conductive pad on the bonding electrode; (c) forming a second electrode on the second substrate along a second direction, and forming a second conductive pad on a first end of the second electrode, the second direction being substantially perpendicular to the first direction; (d) forming a sealing frit between the first electrode and the bonding electrode for sealing the first substrate and the second substrate; and (e) connecting the first conductive pad with the second conductive pad, and bonding the first substrate and the second substrate so that the second electrode of the second substrate is electrically connected to the bonding electrode of the first substrate.

According to another aspect of the present invention, the plasma display panel (PDP) connected with an outer circuit includes a first substrate having a tipper surface and a second substrate having a lower surface. The upper surface includes a covered region and an exposed region, the exposed region has a first edge, and the second substrate has a second edge. The second substrate is positioned above the covered region of the first substrate, the lower surface of the second substrate faces the upper surface of the first substrate, and the exposed region of the first substrate being protruded from the second edge of the second substrate. The PDP further includes a signal electrode, a bonding electrode, a first conductive pad, and a second conductive pad. The signal electrode is disposed on the lower surface of the second substrate and extended to the second edge of the second substrate. The bonding electrode is disposed on the upper surface of the first substrate and extending from the covered region to the exposed region. Besides, the bonding electrode above the exposed region of the first substrate is connected to the outer circuit. The first conductive pad is protruded from the upper surface of the first substrate and electrically connected with the bonding electrode, and the second conductive pad is protruded from the lower surface of the second substrate to contact with the first conductive pad and electrically connected with the signal electrode. The bonding electrode is electrically connected with the outer circuit and the signal electrode is electrically connected with the bonding electrode through the first and the second conductive pads so that the signal electrode is electrically connected to the outer circuit.

The present invention may best be understood through the following description with reference to the accompanying drawings, in which:

DETAILED DESCRIPTION OF THE PREFERRED EMBODIMENTS

The plasma display panel (PDP) of the present invention includes a first substrate, a second substrate, a first electrode, a second electrode, a bonding electrode and a conductive device. The substrates are preferably made of glass, and the second substrate is disposed on the first substrate with a space therebetween so that a upper surface of the first substrate is faced to a lower surface of the second substrate. The first substrate has a first length and the second substrate has a second length, the first length is longer than the second length. The first electrode is disposed on the first substrate along a first direction, the second electrode is disposed on the second substrate along a second direction, and the second is substantially perpendicular to the first direction. Since the first length of the first substrate is longer than the second length of the second substrate, a portion of the first substrate will be exposed and not covered by the second substrate. The bonding electrode is disposed on a first edge of the first substrate where is not covered by the second substrate. Besides, the conductive device includes a first and a second conductive pads. The first conductive pad is extruded from the bonding electrode and the second conductive pad is extruded from the second electrode for connecting with the first conductive pad.

In the present invention, the driving circuits are not mounted on the two substrates. In contrast to the prior art, the driving circuits are bounded on only one substrate. The first electrode on the first substrate (the larger substrate) is connected with its corresponding outer circuit on the first substrate directly, and the second electrode on the second substrate (the smaller substrate) is connected with its corresponding outer circuit on the first substrate (the larger substrate) through the conductive device and the bonding electrode. Since both of the power-supplying routes of the first and second electrodes are modified, the mounting steps for forming diving circuits on the substrates of the PDP are also simplified.

Figure 1:
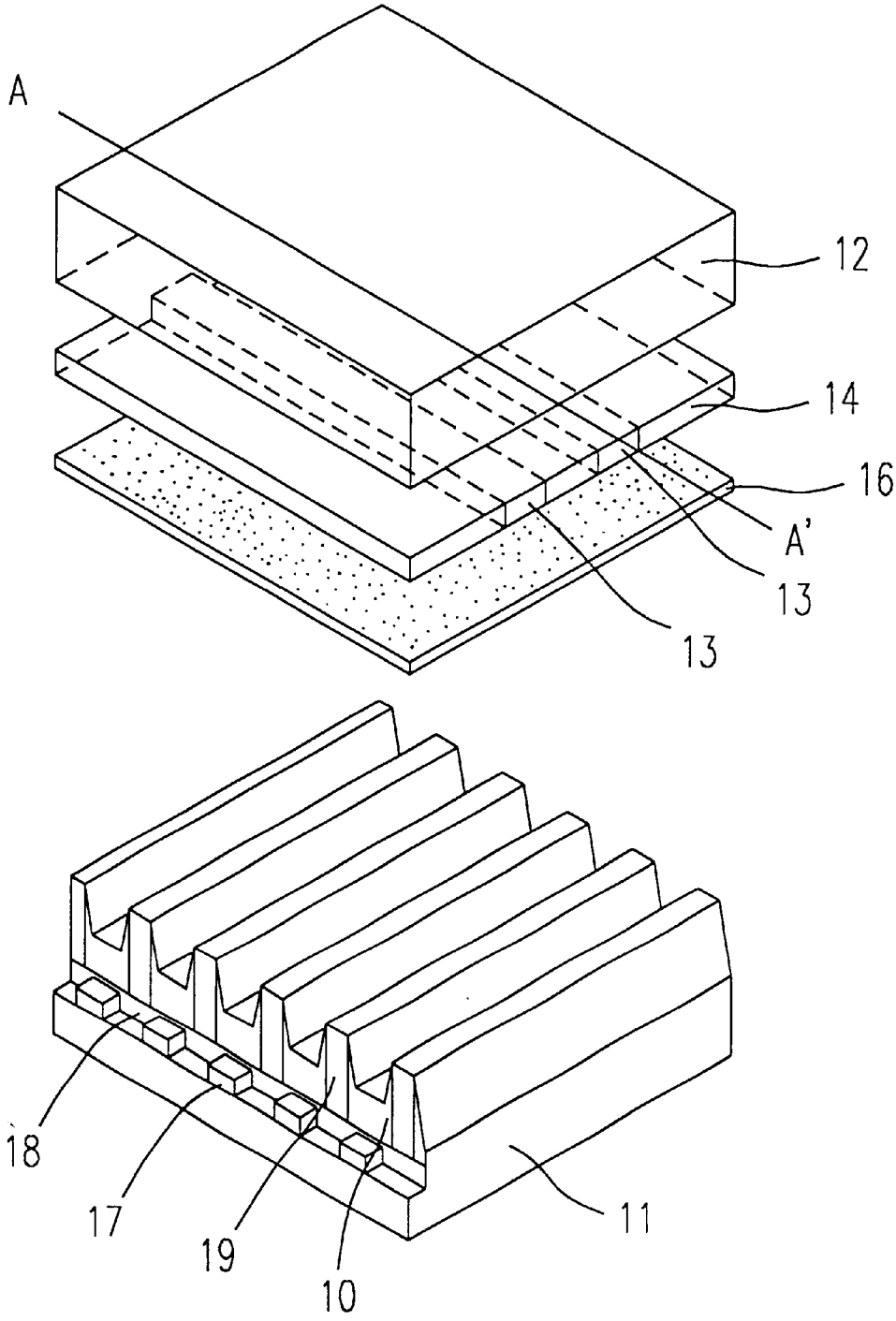
Fig. 1(PRIOR ART)
FIG. 1 is a perspective view of a conventional PDP.
Figure 2:
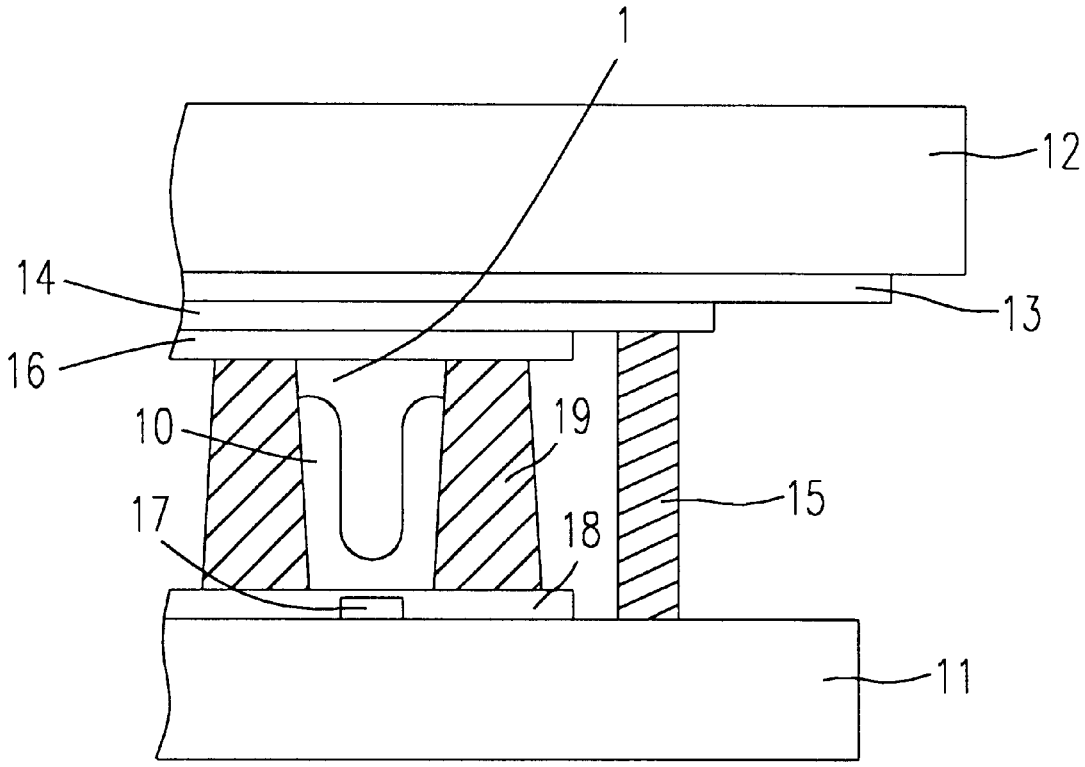
Fig. 2(PRIOR ART)
FIG. 2 is a sectional view of the conventional PDP in FIG. 1 along A–A' line.
Figure 3:
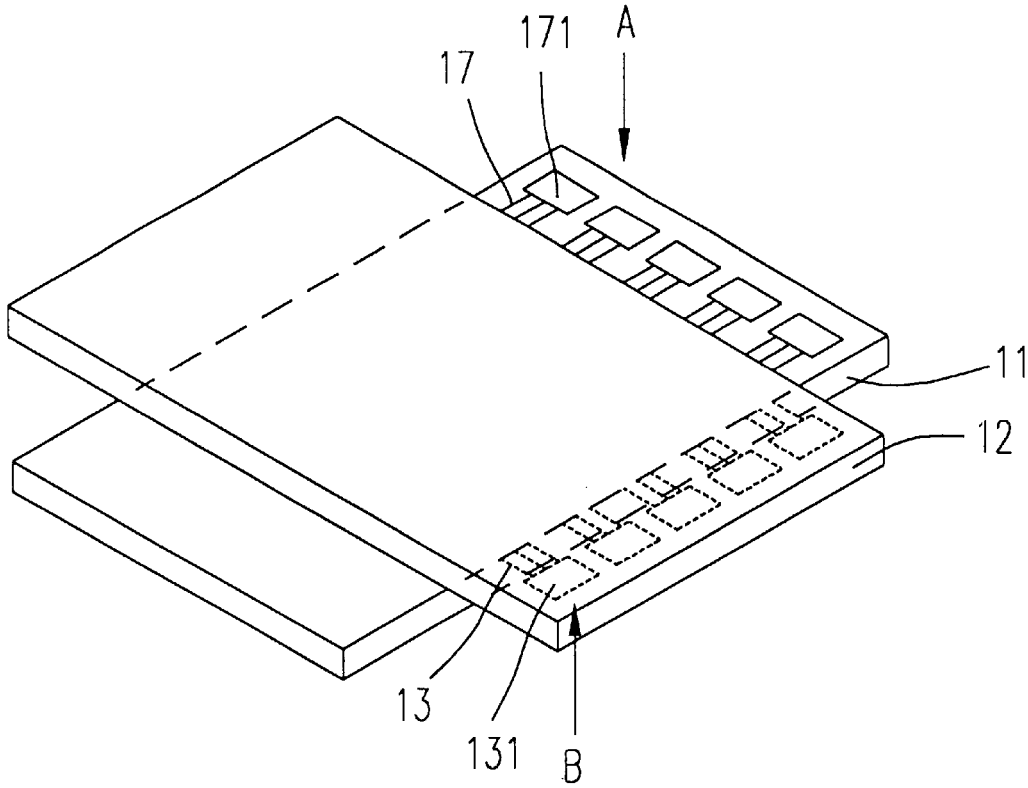
Fig. 3(PRIOR ART)
FIG. 3 is a top view of the conventional PDP in FIG. 1.
Figure 4:
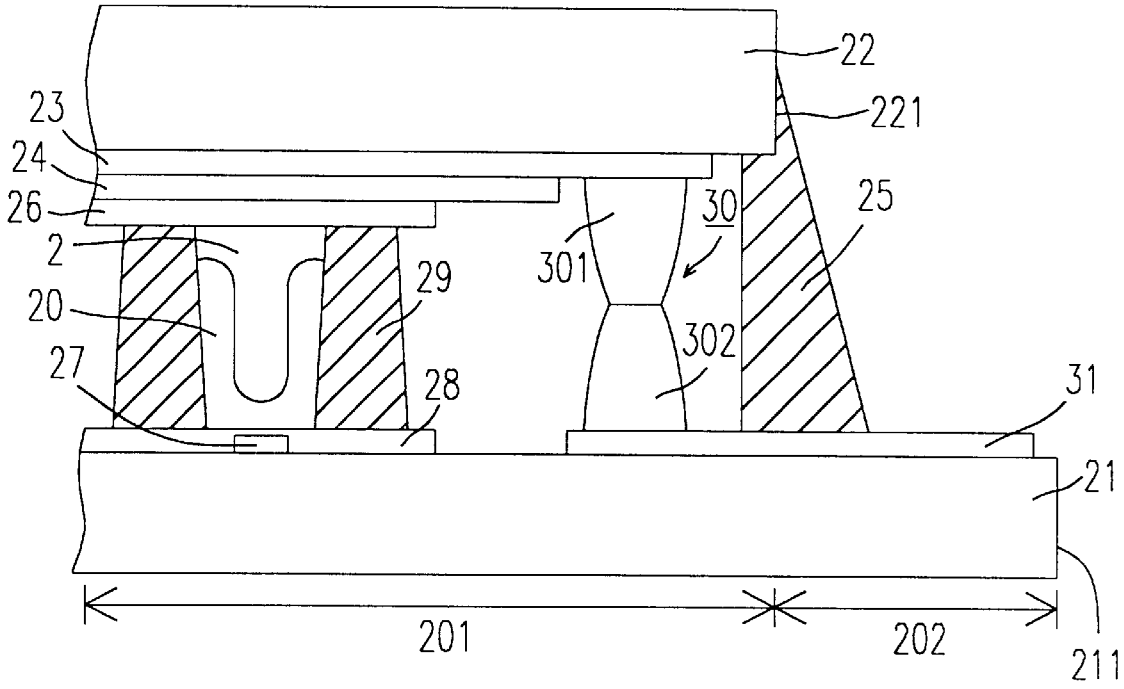
FIG. 4 is a first preferred embodiment of the PDP according to the present invention.

FIG. 4 shows a first preferred embodiment of the PDP according to the present invention. In this case, the first substrate is a rear substrate 21 having an addressing electrode 27 (the first electrode) thereon. The second substrate is a front substrate 22 having a scanning electrode 23 (the second electrode) thereon. The length of the rear substrate 21 is longer than that of the front substrate 22. Therefore, when the two substrates are assembled together, one part (the covered region 201) of the rear substrate 21 is covered by the front substrate 22 and the other part (the exposed region 202) is not. A dielectric layer 24 is formed on the scanning electrode 23 for protecting the scanning electrode 23, and a first protecting layer 26, usually a MgO layer, is formed on the dielectric layer 24 and used for maintaining surface charges of the scanning electrode 23. A second protecting layer 28 is formed on the addressing electrode 27 for protecting the addressing electrode 27. The PDP further includes a barrier rib 29 disposed between the two substrates 21•22 for defining a plurality of discharge cells 2. The inner walls of the each cell 2 are coated with a fluorescent layer 20, and a nixing inert gas of xenon (Xe) and neon (Ne) is sealed therein. When a high voltage is exerted between the electrode 23 and 27, a plasma discharge is introduced in the discharge cell 2 to excite the fluorescent layer 20 to radiate visible lights.

In addition, the PDP further includes a sealing frit 25, usually made of glassy slurry, disposed between the front 22 and rear 21 substrates. The sealing frit is preferably between a first edge 211 of the exposed region 202 and a second edge 221 of the second substrate 22 for sealing and fixing the two substrates 21•22.

Figure 5:
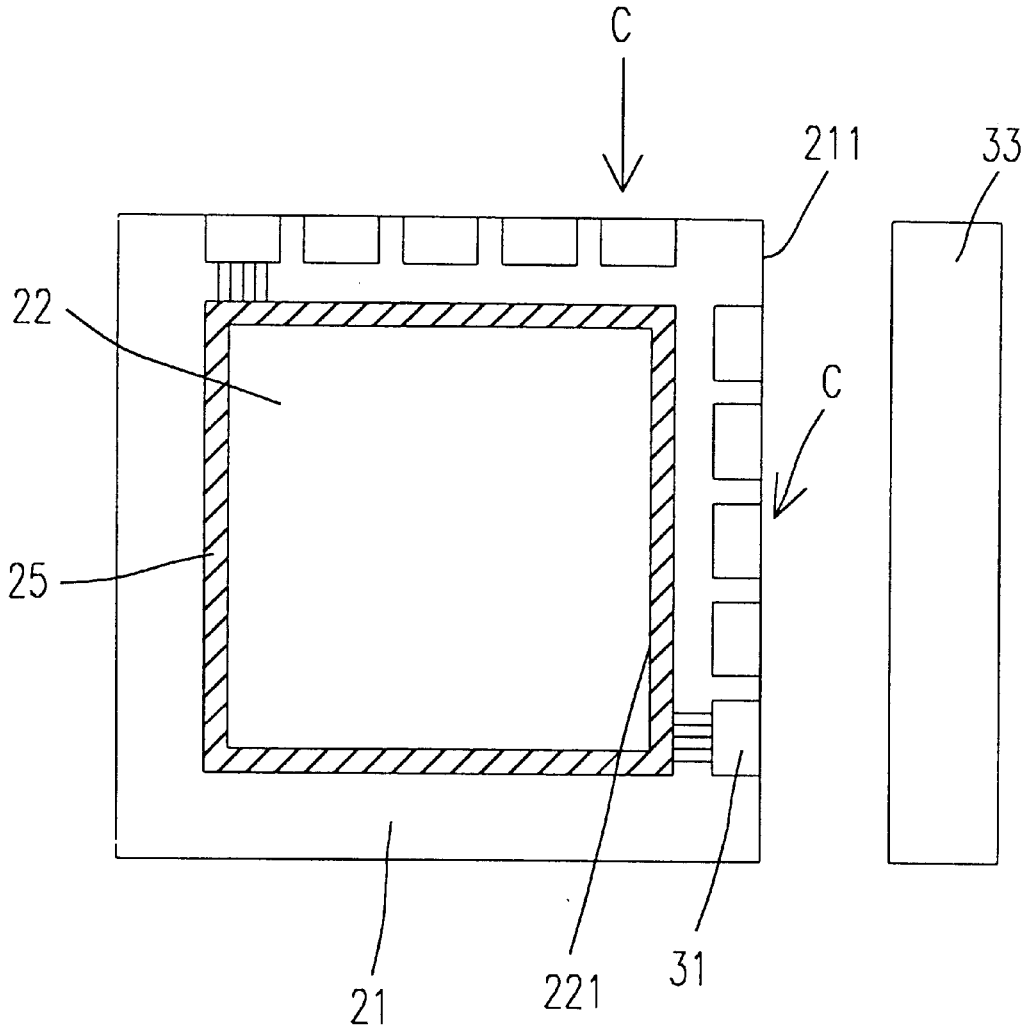
FIG. 5 is a top view of the PDP in FIG. 4.

The scanning electrode 23 is extended to the second edge 221 of the front substrate 22, and the bonding electrode 31 is extended from the covered region 201 to the first edge 211 of the exposed region 202 so that the scanning electrode 23 can be electrically connected to the bonding electrode 31 through a conductive device 30. The conductive device 30 includes a first conductive pad 301 and a second conductive pad 302. The first conductive pad 301 is extruded downward from the scanning electrode 23 of the front substrate 22 and a second conductive pad 302 extruded upward from the bonding electrode 31 of the rear substrate 21 for connecting with the first conductive pad 301. As shown in FIG. 5, one end of the bonding electrode 31 is electrically connected with an outer circuit 33, such as a flexible printed circuit (FPC) for driving the scanning electrode 23. All outer circuits 33 are mounted on the rear substrate 21 by the only one direction C. Through the first conductive pad 301, the second conductive pad 302, the bounding electrode 31, the scanning electrode 23 on the front substrate 22 can be electrically connected to the outer circuit 33. Therefore, the step of mounting driving circuit is simplified. In addition, the first and second conductive pads are contact for each other, the two substrates can be sealed in the right position easily.

Figure 6:
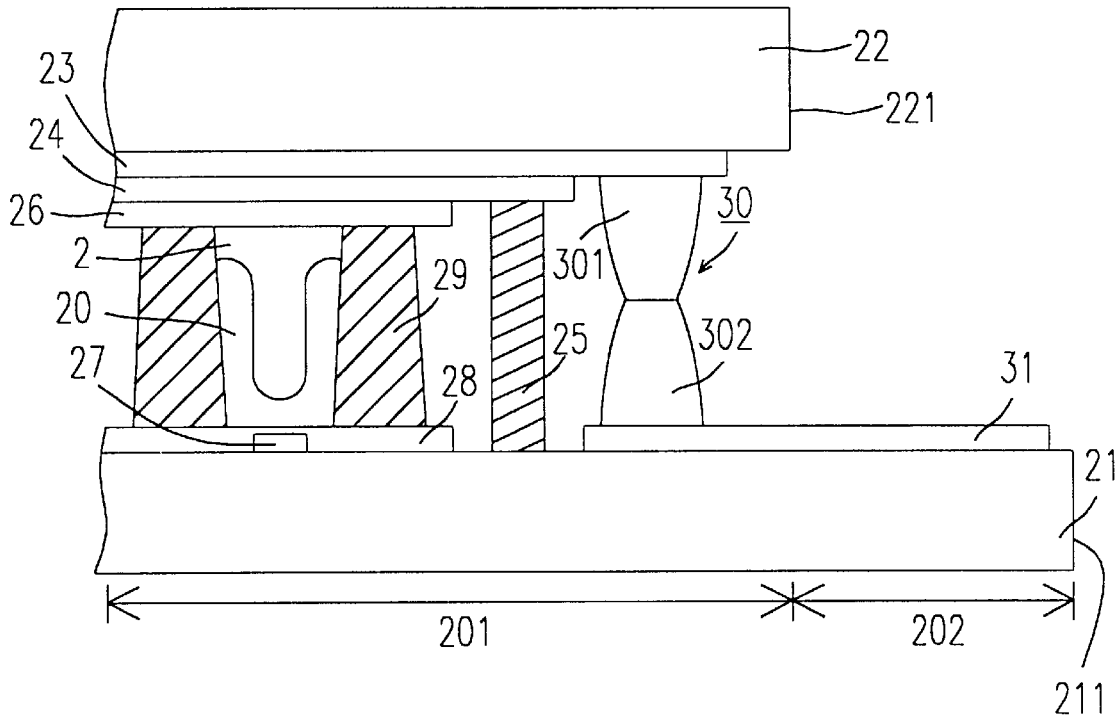
FIG. 6 is a second preferred embodiment of the PDP according to the present invention.
Figure 7:
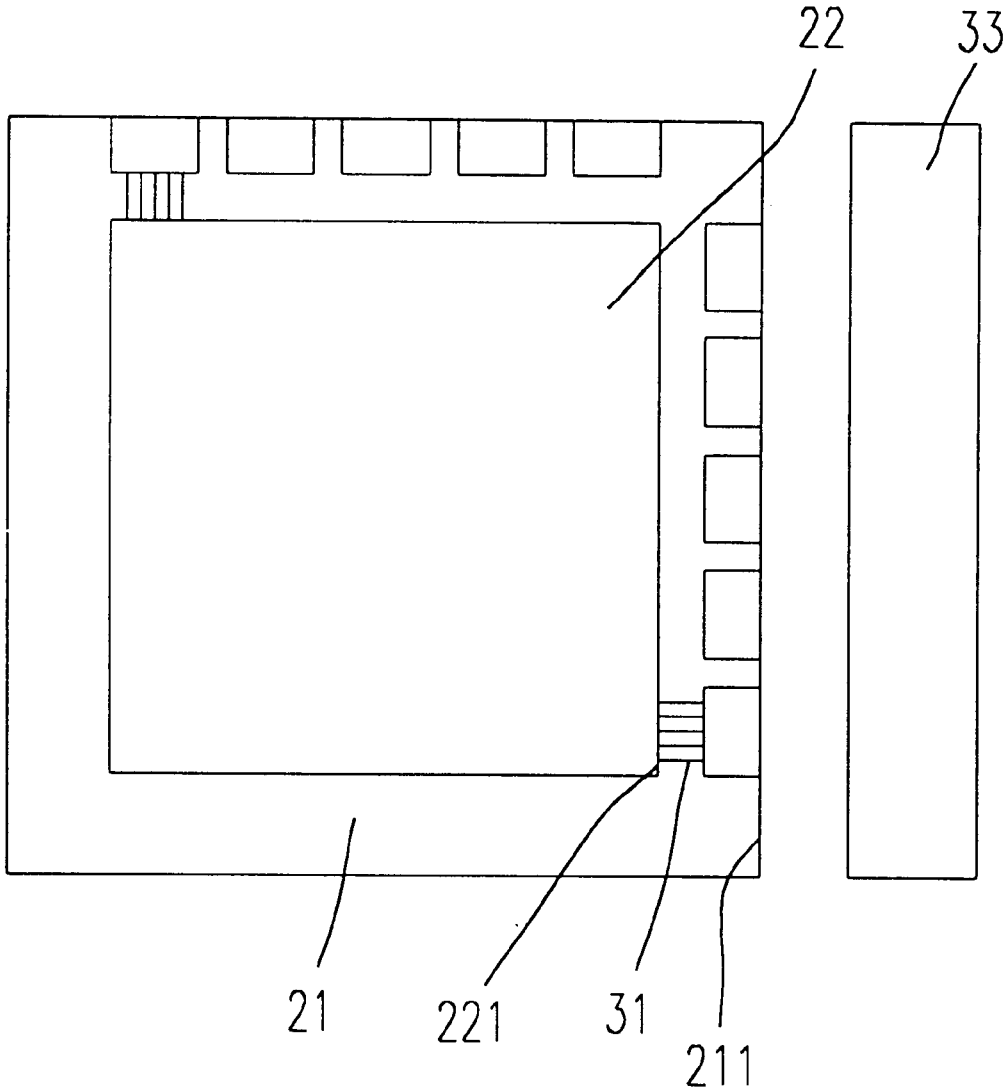
FIG. 7 is a top view of the PDP in FIG. 6.

FIG. 6 shows a second preferred embodiment of the PDP according to the present invention. In this case, the sealing frit 25 is changed to be disposed in the covered region 201, preferably, the sealing frit 25 is positioned between the conductive device 30 and the barrier rib 29. FIG. 7 is a top view of the PDP in FIG. 6.

As shown in FIGS. 4 to 7, the character of the present is that the length of the rear substrate is longer than that of the front substrate. By using the bonding electrode and the conductive device, the power-supplying routes of the electrodes on the smaller substrate are changed. Therefore, the driving circuits only have to be formed on one substrate from one direction, and the sealing frit can be formed along the boundary of the smaller substrate easily. The efficiency of manufacturing the PDP is also increased.

Figure 8:
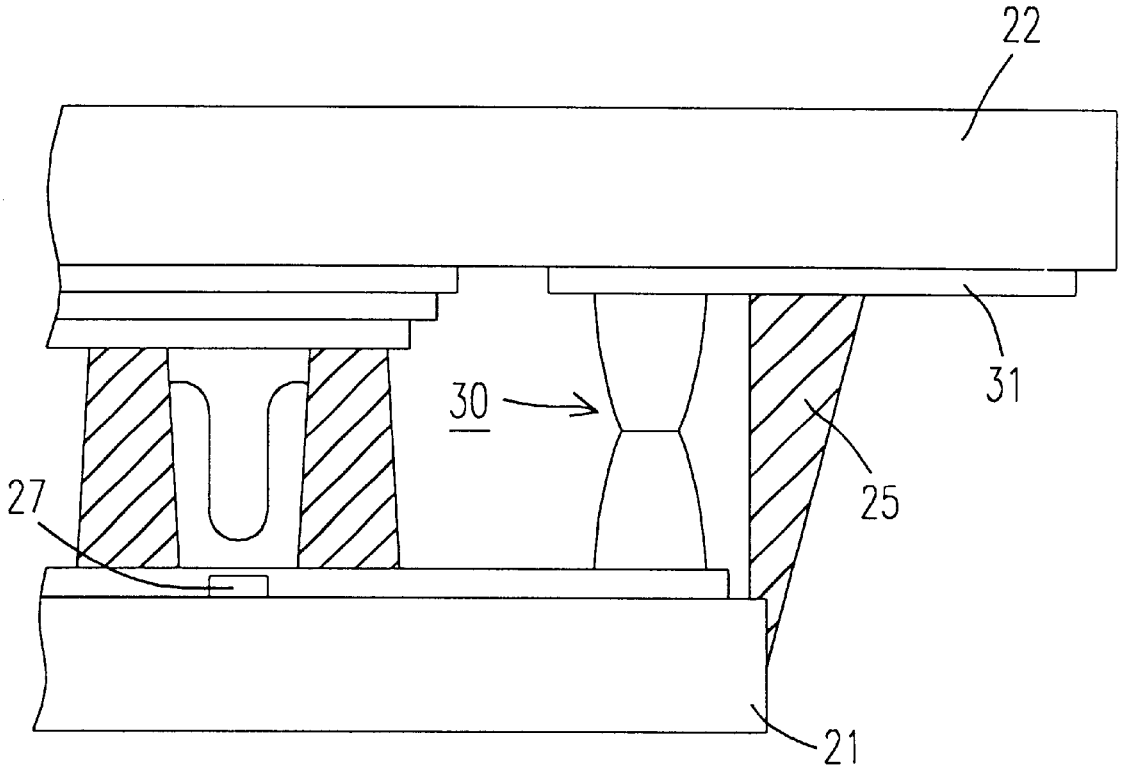
FIG. 8 is a third preferred embodiment of the PDP according to the present invention.
Figure 9:
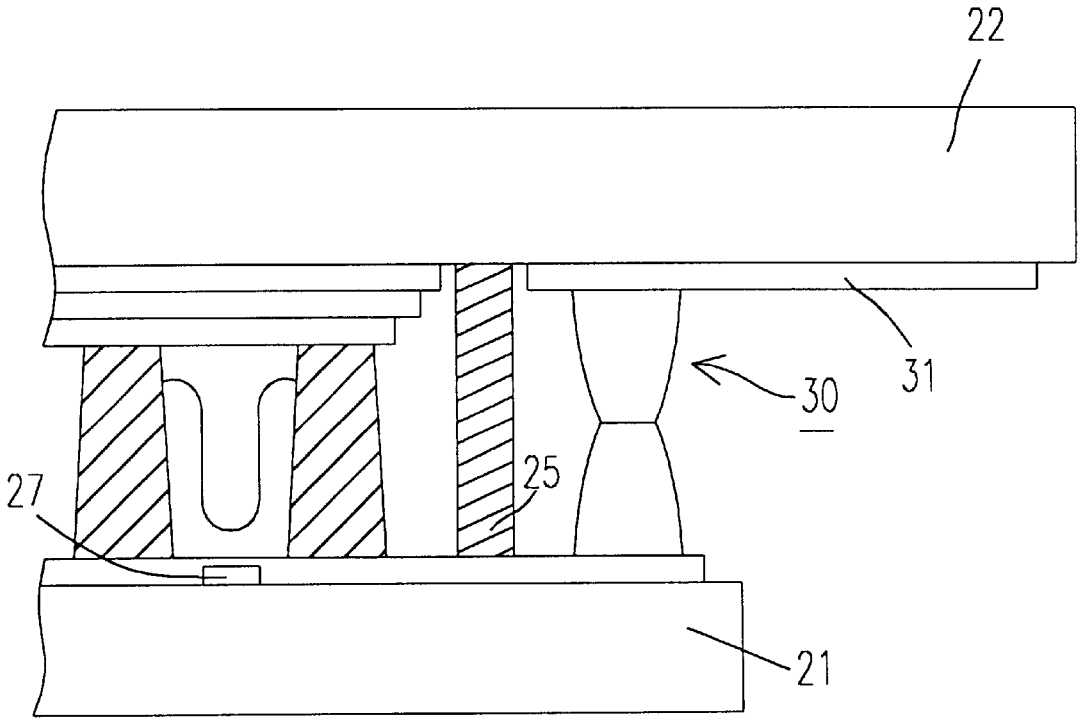
FIG. 9 is a fourth preferred embodiment of the PDP according to the present invention.

FIG. 8 and FIG. 9 show other two preferred embodiments of the present invention. These two embodiments are different from the above-described two embodiments by using a longer front substrate. That is to say, the length of the front substrate is longer than that of the rear substrate. When the two substrates are sealed and mounted together, the front substrate will be protruded from the rear substrate. The difference between FIGS. 8 and 9 is the position of the sealing frit 25.

Figure 10:
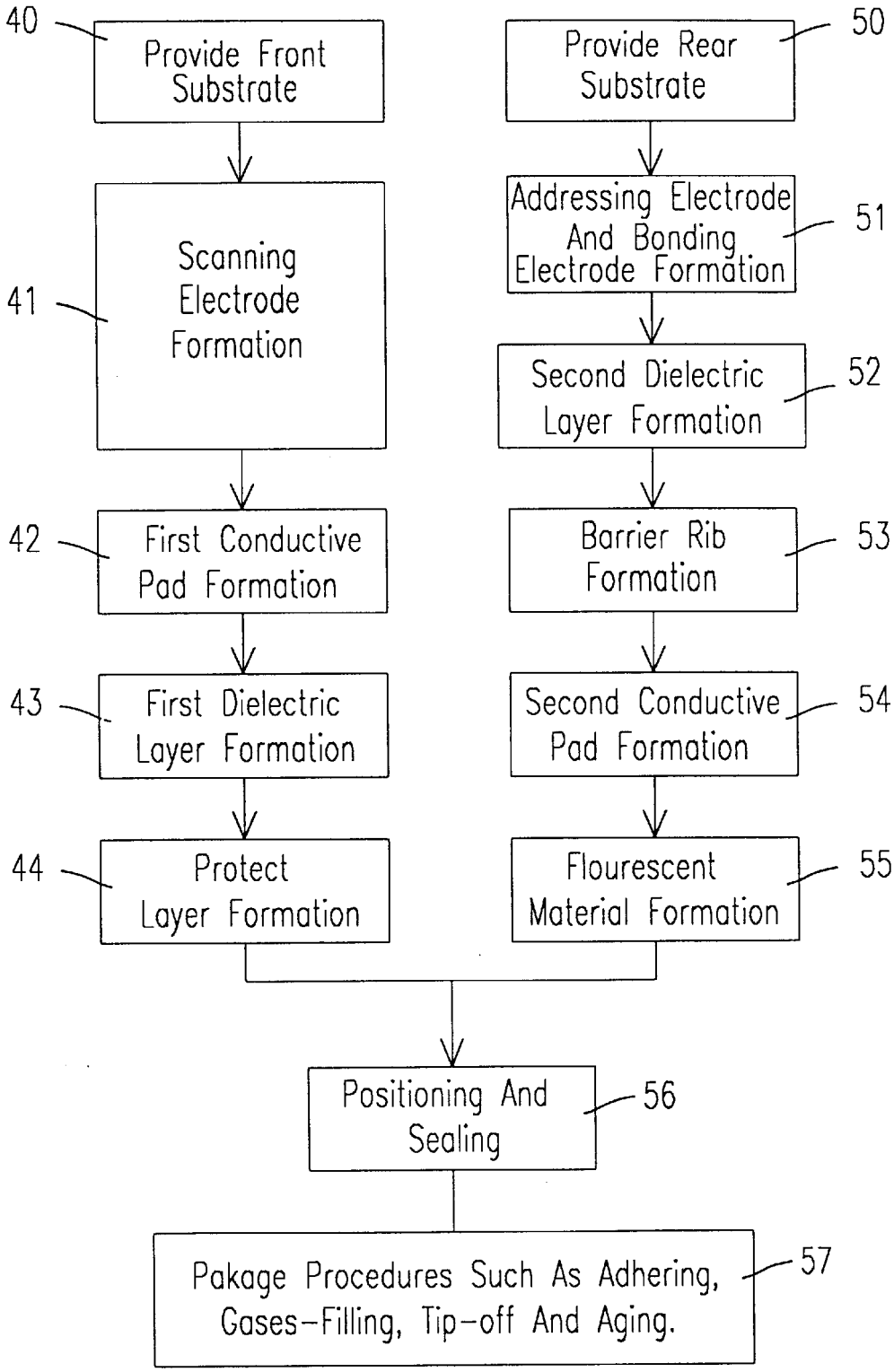
FIG. 10 is a flowchart of a first method for manufacturing a PDP according to the present invention.
Figure 11:
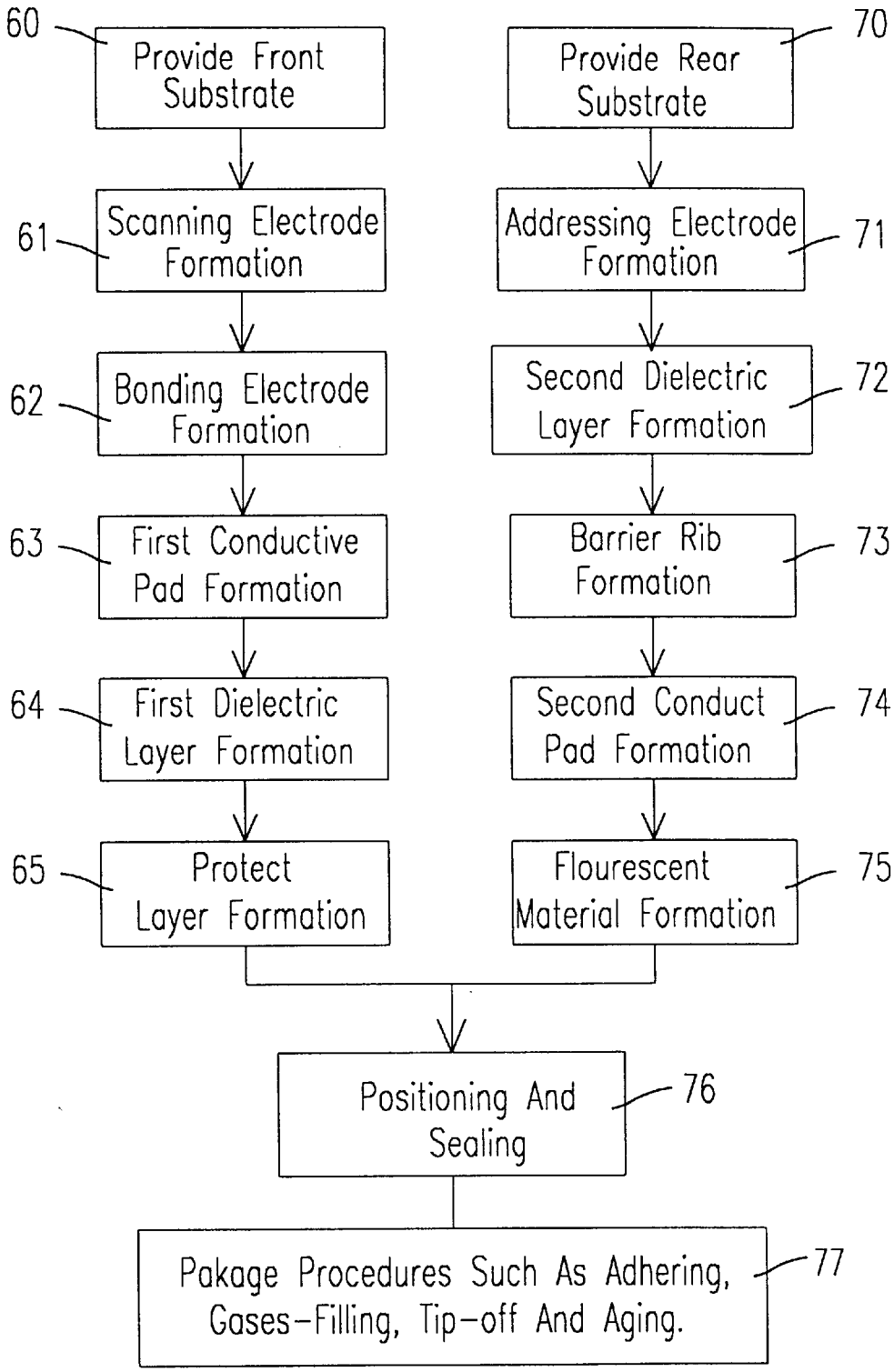
FIG. 11 is a flowchart of a second method for manufacturing a PDP according to the present invention.

As described above, the PDPs of the present invention can be classified as a rear-substrate-extension PDP and a front-substrate-extension PDP according to the length relation between the front and rear substrates. FIG. 10 and FIG. 11 respectively show the flowcharts of the method to manufacture the rear-substrate-extension PDP and the front-substrate-extension PDP.

FIG. 10 is the flowchart showing the method for manufacturing the rear-substrate-extension PDP according to the present invention. First, a front substrate is provided (step 40) and the scanning electrode is formed on the front substrate (step 41). Then, the first conductive pad is formed and protruded from the scanning electrode (step 42). Thereafter, the first dielectric layer (step 43) and the protect layer (step 44) are formed on the scanning electrode. In the same time, a rear substrate is also provided (step 50), an addressing electrode and the bonding electrode are then formed on the rear substrate (step 51). Since only parts of the rear substrate is covered by the front substrate, the rear substrate can be divided into a covered region and an exposed region. The bonding electrode is extended from the covered region to the exposed region. Then, the second dielectric layer is formed on the addressing electrode for protecting the addressing electrode (step 52). Therefore, the barrier rib is formed between the two substrates for defining the plurality of discharge cells (step 53), and the second conductive pad is formed and protruded from the bonding electrode (step 54). Then, the inner wall of each cell is coated with the fluorescent material (step 55) for displaying visible light. Finally, the front and rear substrates are positioned precisely and the sealing frit is formed between the two substrates (step 56). The sealing frit can be formed on the outer edge of front substrate (smaller substrate) or formed between the barrier rib and the conductive pads. After that, the package procedures, including steps of adhering, gases filling, tip-off, and aging, are further processed (step 57).

FIG. 11 is the flowchart showing the method for manufacturing the front-substrate-extension PDP according to the present invention. The difference between FIGS. 10 and 11 is the binding electrode is formed on the front substrate. First, a front substrate is provided (step 60), the scanning electrode (step 61) and the bonding electrode (step 62) are then formed on the front substrate. A part of the front substrate is covered by the rear substrate so the front substrate is divided as a covered region and an exposed region. Then, the first conductive pad is formed and protruded from the bonding electrode (step 63), the first dielectric layer (step 64) and the protect layer (step 65) are formed on the scanning electrode. In the same time, a rear substrate is also provided (step 70), an addressing electrode is formed on the rear substrate (step 71). Thereafter, the second dielectric layer is formed on the addressing electrode for protecting the addressing electrode (step 72). The barrier rib is then formed between the two substrates for defining the plurality of discharge cells (step 73), and the second conductive pad is formed and protruded from the addressing electrode (step 74). Then, the inner wall of each cell is coated with the fluorescent material (step 75) for displaying visible light. Finally, the front and rear substrates are positioned precisely and the sealing frit is formed between the two substrates (step 76). The sealing frit can be formed on the outer edge of rear substrate (smaller substrate) or between the barrier rib and the conductive pads. After that, the package procedures, including steps of adhering, gases filling, tip-off, and aging, are further processed (step 77).

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A plasma display panel (PDP) comprising:

a first substrate having a first edge;

a second substrate spaced apart from said first substrate, wherein said second substrate has a first length and said second substrate has a second length, said first length is longer than said first length;

a first electrode positioned on said first substrate along a first direction;

a second electrode positioned on said second substrate along a second direction, said second direction being substantially perpendicular to said first direction;

a bonding electrode disposed on said first edge of said first substrate uncovered by said second substrate; and a conductive device having a first and a second conductive pads, said first conductive pad being protruded from said bonding electrode, and said second conductive pad being protruded from said second electrode and contacting with said first conductive pad;

wherein said bonding electrode on said first substrate is electrically connected with an outer circuit such that said second electrode of said second substrate is electrically connected with said outer circuit through said conductive device and said bonding electrode.

2. The PDP according to claim 1, further comprising a sealing frit disposed between said first and said second substrates for sealing said first and second substrates.

3. The PDP according to claim 2 wherein said sealing frit is positioned between said conductive device and said first edge of said first substrate.

4. The PDP according to claim 2 wherein said PDP further includes a barrier rib formed between said first and said second substrates for defining a discharge cell and said sealing frit is positioned between said conductive device and said barrier rib.

5. A method for manufacturing a plasma display panel (PDP), said PDP having a first substrate and a second substrate spaced apart from said first substrate, said first substrate having a first length and said second substrate having a second length, said first length being longer than said second length, said method comprising steps of:

(a) forming a first electrode on said first substrate along a first direction;

(b) forming a bonding electrode on a first edge of said first substrate uncovered by said second substrate, and forming a first conductive pad on said bonding electrode;

(c) forming a second electrode on said second substrate along a second direction, and forming a second conductive pad on a first end of said second electrode, said second direction being substantially perpendicular to said first direction;

(d) connecting said first conductive pad with said second conductive pad, and bonding said first and said second substrates so that said second electrode of said second substrate is electrically connected to said bonding electrode of said first substrate; and (e) forming a sealing frit around said first substrate for sealing said first substrate and said second substrate.

6. A method for manufacturing a plasma display panel (PDP), said PDP having a first substrate and a second substrate spaced apart from said first substrate, said first substrate having a first length and said second substrate having a second length, said first length being longer than said second length, said method comprising steps of:

(a) forming a first electrode on said first substrate along a first direction;

(b) forming a bonding electrode on a first edge of said first substrate uncovered by said second substrate, and forming a first conductive pad on said bonding electrode;

(c) forming a second electrode on said second substrate along a second direction, and forming a second conductive pad on a first end of said second electrode, said second direction being substantially perpendicular to said first direction;

(d) forming a sealing frit between said first electrode and said bonding electrode for sealing said first substrate and said second substrate; and (e) connecting said first conductive pad with said second conductive pad, and bonding said first substrate and said second substrate so that said second electrode of said second substrate is electrically connected to said bonding electrode of said first substrate.

7. A plasma display panel (PDP) connected with an outer circuit, said PDP comprising:

a first substrate having a upper surface, said upper surface including a covered region and an exposed region, said exposed region having a first edge;

a second substrate having a lower surface and a second edge, said second substrate being positioned above said covered region of said first substrate, said lower surface of said second substrate being faced said upper surface of said first substrate, and said exposed region of said first substrate being protruded from said second edge of said second substrate;

a signal electrode disposed on said lower surface and extended to said second edge of said second substrate;

a bonding electrode disposed on said upper surface of said first substrate, said bonding electrode extending from said covered region to said exposed region, and said bonding electrode above said exposed region connecting to said outer circuit;

a first conductive pad protruded from said upper surface of said first substrate and electrically connected with said bonding electrode; and a second conductive pad protruded from said lower surface of said second substrate to contact with said first conductive pad and electrically connected with said signal electrode, wherein said bonding electrode is electrically connected with said outer circuit and said signal electrode is electrically connected with said bonding electrode through said first and said second conductive pads so that said signal electrode is electrically connected to said outer circuit.

8. The PDP according to claim 7, further comprising a sealing frit for sealing said first and said second substrates.

9. The PDP according to claim 8 wherein said sealing frit is disposed between and used for connecting said exposed region of said first substrate and said second edge of said second substrate.

10. The PDP according to claim 8 wherein said sealing frit is disposed between and used for connecting said covered region of said first substrate and said lower surface of said second substrate.

11. A method for manufacturing a plasma display panel (PDP), said PDP being connected to an outer circuit, said PDP having a first substrate and a second substrate, said first substrate having a upper surface and said second substrate having a lower surface, said tipper surface having a covered region and an exposed region, said exposed region having a first edge and said second substrate having a second edge, said method comprising steps of:

(a) forming a bonding electrode on said first substrate and forming a first conductive pad protruded from said bonding electrode, said bonding electrode being extended from said covered region to said exposed region;

(b) forming a signal electrode and a second conductive pad on said second substrate, said signal electrode being extended to said second edge of said second substrate, and said second conductive pad being protruded from said signal electrode; and (c) disposing said second substrate on said covered region of said first substrate in order to make said exposed region of said first substrate exposed from said second edge of said second substrate, and connecting said first conductive pad and said second conductive pad for allowing said signal electrode on said second substrate connecting with said bonding electrode on said first substrate so that said bonding electrode on said exposed region being connected to said outer circuit.

12. The method according to claim 11, after said step (c), further comprising a step (d) of forming a sealing frit between said exposed region of said first substrate and said second edge of said second substrate for sealing said first and said second substrates.

13. A method for manufacturing a plasma display panel (PDP) method, said PDP having a first substrate and a second substrate, said first substrate having a upper surface and said second substrate having a lower surface, said upper surface having a covered region and an exposed region, said exposed region having a first edge and said second substrate having a second edge, said method comprising steps of:

(a) forming a bonding electrode, a first conductive pad, and a sealing frit on said upper surface of said first substrate, said bonding electrode being extended from said covered region to said exposed region of said first substrate, said first conductive pad protruded from said bonding electrode, and said sealing frit protruded from said covered region of said first substrate;

(b) forming a signal electrode and a second conductive pad, said signal electrode being extended to said second edge of said second substrate and said second conductive pad protruded from said signal electrode;

(c) disposing said second substrate on said covered region of said first substrate in order to make said exposed region of said first substrate exposed from said second edge of said second substrate, and connecting said first conductive pad and said second conductive pad for allowing said signal electrode on said second substrate connecting with said bonding electrode on said first substrate so that said bonding electrode on said exposed region be connected with said outer circuit; and (d) connecting said sealing frit with said lower surface of said second substrate for sealing said first and said second substrates to from said PDP.

* * * * *